US005408971A

United States Patent [19]

Jaeger et al.

[11] Patent Number: 5,408,971

[45] Date of Patent: Apr. 25, 1995

[54] FUEL RAIL CONSTRUCTION FOR AN ELECTRONIC FUEL INJECTED ENGINE

[75] Inventors: Matthew W. Jaeger, Fond du Lac, Wis.; Steven M. Lippincott, Stillwater, Okla.; Jerry M. Stoll, Jr., Stillwater, Okla.; Brian R. White, Stillwater, Okla.

[73] Assignee: Brunswick Corporation, Lake Forest, Ill.

[21] Appl. No.: 104,440

[22] Filed: Aug. 9, 1993

[51] Int. Cl.[6] ..... F02M 41/00; F02M 55/02

[52] U.S. Cl. ..... 123/456; 123/469; 123/470

[58] Field of Search ..... 123/456, 468, 469, 470, 123/514

[56] References Cited

U.S. PATENT DOCUMENTS

| | | | |
|---|---|---|---|
| 4,539,961 | 9/1985 | Atkins et al. | 123/468 |
| 4,570,602 | 2/1986 | Atkins et al. | 123/456 |
| 4,586,477 | 5/1986 | Field et al. | 123/468 |
| 4,844,036 | 7/1989 | Bassler et al. | 123/470 |
| 4,955,409 | 9/1990 | Tokuda et al. | 123/456 |
| 5,022,371 | 6/1991 | Daly | 123/468 |
| 5,088,463 | 2/1992 | Affeldt et al. | 123/456 |
| 5,143,039 | 9/1992 | Gmelin | 123/456 |
| 5,146,901 | 9/1992 | Jones | 123/514 |
| 5,163,406 | 11/1992 | Daly et al. | 123/456 |
| 5,168,856 | 12/1992 | Lorraine | 123/456 |
| 5,197,436 | 3/1993 | Ozawa | 123/456 |
| 5,285,759 | 2/1994 | Terada et al. | 123/514 |

*Primary Examiner*—Andrew M. Dolinar
*Assistant Examiner*—Thomas N. Moulis
*Attorney, Agent, or Firm*—Andrus, Sceales, Starke & Sawall

[57] ABSTRACT

A fuel rail assembly for an internal combustion engine including an elongated rail having a longitudinal inlet passage and a longitudinal outlet passage. The upstream end of the inlet passage is connected to a fuel supply line while the downstream end of the inlet passage is connected through a pressure regulator to the upstream end of the outlet passage. A return fuel line is connected to the downstream end of the outlet passage. A plurality of injector bores communicate with the inlet passage and extend to the exterior of the rail and each injector bore receives one end of a fuel injector, while the opposite end of each injector is sealed within a bore in a runner of an intake manifold. The injectors are mounted in a manner to provide limited tilt to facilitate assembly with the bores in the fuel rail and the manifold reservoir.

14 Claims, 2 Drawing Sheets

FIG. 1
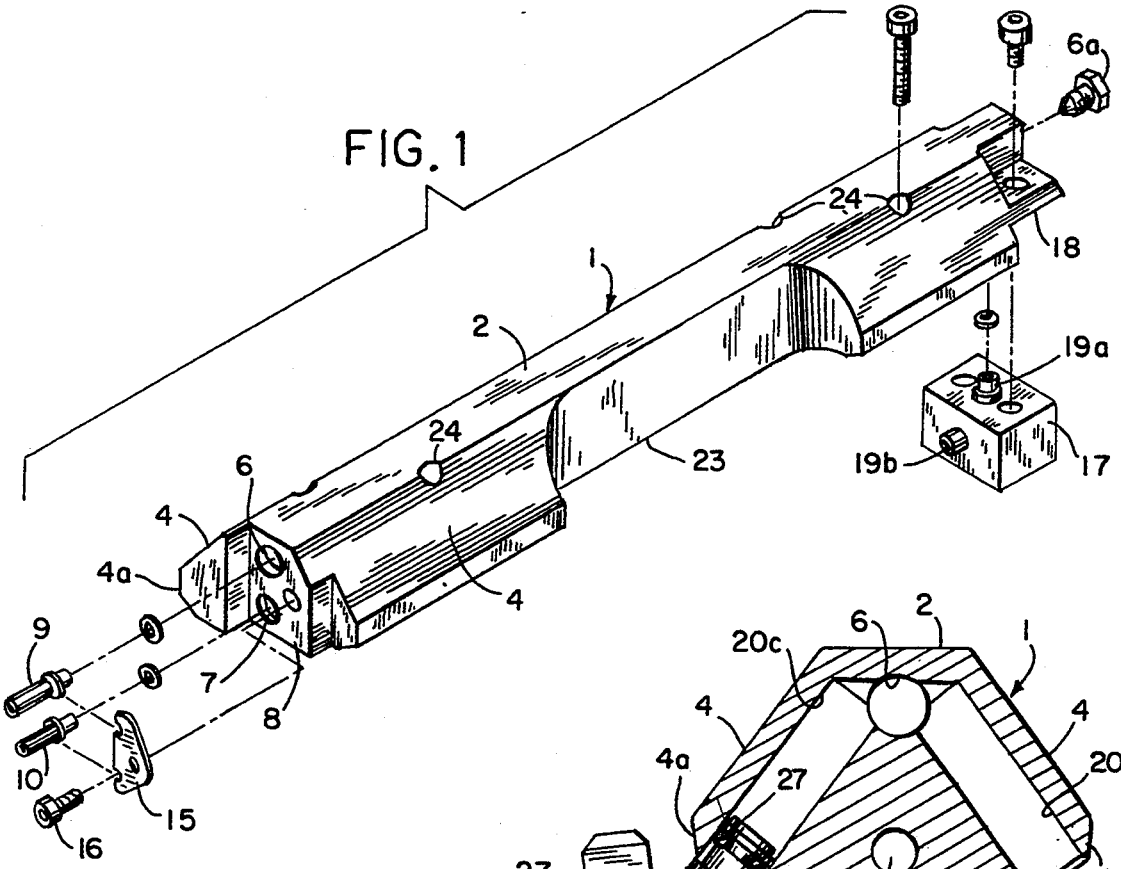
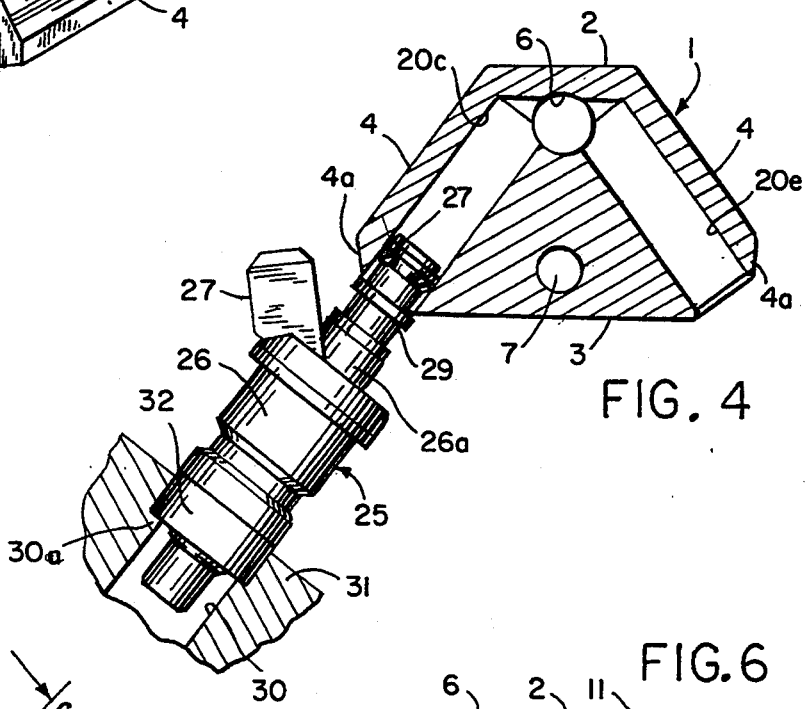
FIG. 4
FIG. 5
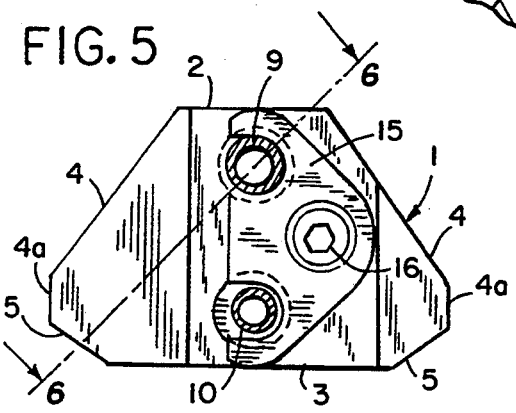
FIG. 6
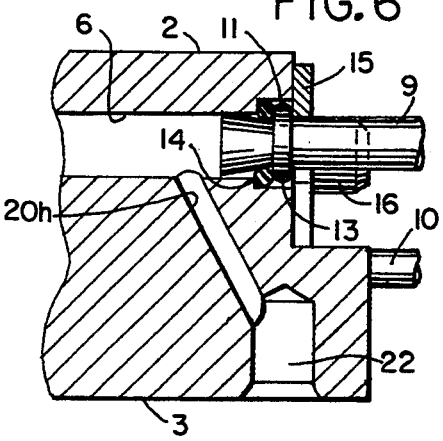

FUEL RAIL CONSTRUCTION FOR AN ELECTRONIC FUEL INJECTED ENGINE

BACKGROUND OF THE INVENTION

A typical fuel injected internal combustion engine includes a fuel rail which receives fuel from a fuel supply line and supports a series of fuel injectors which discharge the fuel under pressure into the runners of the engine manifold. In a marine engine, the excess fuel not supplied through the injectors is returned to a vapor separator tank which is connected in the fuel supply line and serves to vent vapor to the engine.

In the past, a typical fuel rail assembly has been composed of two separate metal tubes, namely an inlet tube which is connected to the fuel supply line and an outlet tube which is connected to the return line. A metal tube or hose is connected between the downstream end of the inlet tube and the upstream end of the outlet tube. A series of injectors are mounted in the inlet tube and serve to supply fuel to the runners of the manifold.

The connection of the hose between the two tubes requires seals and connecting fittings and constitutes a potential source of fuel leakage.

SUMMARY OF THE INVENTION

The invention is directed to an improved fuel rail assembly and in particular to a fuel rail assembly to be utilized with a marine-engine.

In accordance with the invention the fuel rail assembly comprises an elongated rail having a longitudinal inlet passage and a parallel longitudinal outlet passage. A fuel supply line is connected to the upstream end of the inlet passage, while a fuel return line is connected to the downstream end of the outlet passage. As a feature of the invention a pressure regulator is connected between the downstream end of the inlet passage and the upstream end of the outlet passage and serves to provide a reduction in pressure for the fuel passing into the outlet passage.

The rail is provided with a plurality of diagonal bores, each of which communicates with the inlet passage and extends to the exterior of the rail. The axes of a first group of the injector bores are located at an angle to the axes of a second group of injector bores.

A fuel injector is mounted in the outer end of each injector bore and is sealed to the bore by an annular seal, such as an O-ring. In addition, an annular resilient cushioning member is disposed around each injector and is located outwardly of the O-ring seal. The cushioning member provides limited tilt of the injector relative to the bore.

The outer end of each injector is received within a bore in the manifold runner and again an annular resilient cushion is positioned around the injector and engages the bore in the manifold runner. The resilient cushioning members permit the injectors to be tilted relative to the fuel rail assembly as well as relative to the manifold to thereby facilitate assembly of the fuel injectors with the manifold.

The invention also includes a novel connecting mechanism for connecting the inlet fuel line and the return fuel line to the end of the fuel rail assembly. In this regard, the end of each fuel line is provided with an annular flange and an annular seal, such as an O-ring, is located axially inward of the flange and seals against the respective passage in the fuel rail. A generally E-shaped clip is secured to the end of the rail and is engaged with the outer surface of each flange to prevent axial displacement of each fuel line from the respective passage.

The invention provides a simple and compact fuel rail assembly in which both the inlet passage and outlet passage are formed in the runner, which preferably is formed of extruded aluminum. With this construction, external hoses or tubes which normally connect the inlet and outlet passages are eliminated, thus minimizing the potential for leakage.

As a further advantage, the pressure regulator is located between the inlet and outlet passages. The pressure of the fuel passing through the pressure regulator is substantially reduced and the pressure reduction tends to promote vaporization of the fuel which, in the case of a marine engine, is returned to the vapor separating tank. With the pressure regulator located between the inlet and outlet passages in the fuel rail assembly and at a substantial distance remote from the vapor separating tank, the vapor generated by virtue of the pressure reduction will tend to coalesce into larger bubbles by the time the fuel is returned to the vapor separating tank, thereby facilitating separation of the vapor from the liquid fuel.

Other objects and advantages will appear during the course of the following description.

DESCRIPTION OF THE DRAWINGS

The drawings illustrate the best mode presently contemplated of carrying out the invention.

In the drawings:

FIG. 1 is an exploded view of the fuel rail assembly;

FIG. 4 is a section taken along line 4—4 of FIG. 2 and showing a connection of a fuel injector to the rail;

FIG. 5 is an end view of the fuel rail showing the attachment of the fuel lines to the fuel rail; and FIG. 6 is a partial section taken along line 6—6 of FIG. 5.

DESCRIPTION OF THE ILLUSTRATED EMBODIMENT

Figure 2:
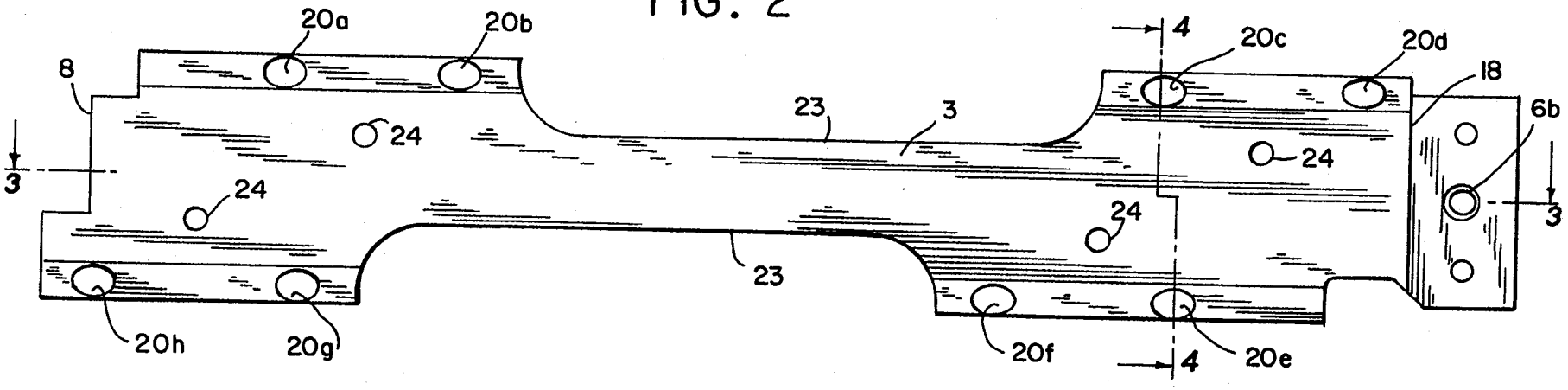
FIG. 2 is a bottom view of the fuel rail.
Figure 3:
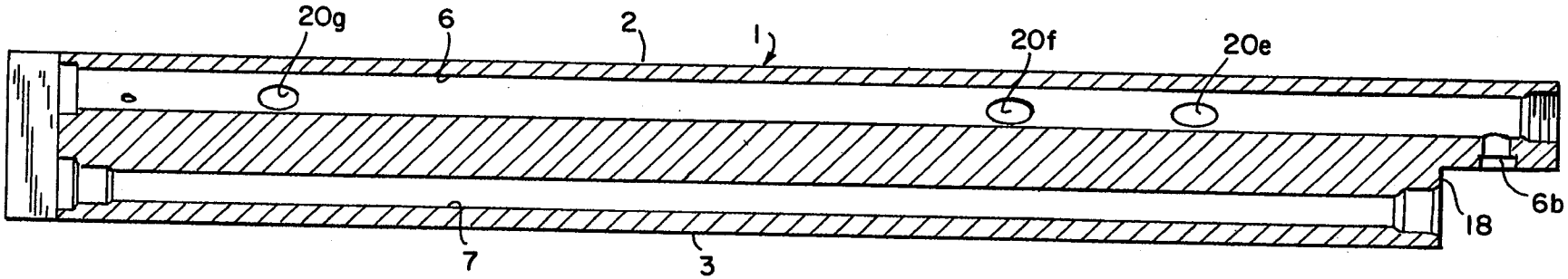
FIG. 3 is a section taken along line 3—3 of FIG. 2.

FIG. 1 shows a fuel rail assembly 1 which has a particular application of use with a fuel injected marine engine. Fuel rail 1 includes a generally flat upper surface 2 and a lower surface 3 which is generally parallel to upper surface 2. A pair of inclined side surfaces 4 extend downwardly from the side edges of upper surface 2, and side surfaces 4 are each connected to bottom surface 3 through surfaces **4*a* and inclined surfaces 5**.

Rail 1 is preferably formed of extruded aluminum and includes a longitudinal inlet passage or bore 6 and a longitudinal outlet passage or bore 7 which is located parallel to and beneath inlet passage 6. The open downstream end of inlet passage 6 is enclosed by a removable threaded fuel service valve **6*a***.

As best shown in FIGS. 1 and 2, an end of rail 1 is provided with a notch 8 which is adapted to clear the distributor for the engine. Fuel lines are connected to the corresponding ends of passages 6 and 7 and because of the presence of the distributor, access is limited for the connections of the fuel lines to the passages. In this regard, a supply fuel line 9 is connected to the upstream end of inlet passage 6 while a return fuel line 10 is connected to the downstream line of the outlet passage 7. The connections of the fuel lines 9 and 10 to the passages 6 and 7 are the same so that the description will be directed to the connection of supply line 9 to passage 6, it being understood that the connection of the return line 10 to passage 7 will be identical.

Passage 6 is provided with an enlarged diameter end 11 which receives the flared end of fuel line 9. A portion of the fuel line spaced from the end thereof is provided with an annular flange 13 and an annular seal, such as an O-ring 14, is located inwardly of the flange 13.

The fuel lines 9 and 10 are retained within the respective passages 6 and 7 by a generally E-shaped retaining clip 15 which is secured to the end of rail 1 by screw 16. The legs of the E-clip 15 bear against the outer surfaces of flanges 13 thereby preventing axial displacement of the fuel lines 9 and 10 from passages 6 and 7.

As a feature of the invention, a pressure regulator 17 is connected between the downstream end of passage 6 and the upstream end of passage 7. The end of rail 1 is formed with a notch 18 which receives the pressure regulator 17 and a filter 19*a* projects outwardly from an inlet opening in the regulator and is received in opening 6*b*, thus providing communication between the downstream end of passage 6 and the inlet of the pressure regulator. The outlet of the pressure regulator is connected to the upstream end of passage 7 via nipple 19*b*. Pressure regulator 17 is a standard type which reduces the pressure of the fuel flowing into the outlet passage 7. The reduction of pressure caused by the fuel flowing through regulator 17 may promote vaporization of the fuel. As pressure regulator 17 is located between passages 6 and 7 and at a substantial distance from the vapor separating tank to which the fuel is returned, the vapor bubbles in the returning fuel have time to coalesce into larger bubbles by the time the fuel returns to the separator tank, thus facilitating the separation of the vapor from the fuel.

Rail 1 is provided with a plurality of injector bores 20*a–g*, as best shown in FIG. 2. One end of each bore communicates with passage 6 while the opposite end of each bore terminates in the inclined surface 5. One group of the injector bores 20*a–d* extend diagonally downwardly and outwardly from passage 6 and terminate in surface 5 on one side of return passage 7, while a second group of the injector bores 20*e–h* extend downwardly and outwardly from inlet passage 6 and terminate in the other surface 5 on the opposite side of return passage 7.

Due to the notch 8, the configuration of the injector bore 20*h* differs from that of injectors 20*a–g*. As shown in FIG. 6, injector bore 20*h* has a smaller diameter than the other injector bores and connects with a lateral section 22. Because of the presence of notch 8, lateral bore 22 could not extend directly inward and communicate with the passage 6.

As best shown in FIG. 2, opposite sides of rail 1 are provided with elongated recesses 23 which provide a clearance to receive the wiring harnesses not shown.

Rail 1 can be attached to the manifold of the engine by a plurality of bolts which extend through the bolt mounting holes 24 formed in the rail, as best shown in FIG. 2.

Conventional fuel injectors 25 are mounted within each of the injector bores 20*a–h*. Each fuel injector includes an elongated body 26 and the terminal 27 for the electrical connections extend outwardly from the central portion of the body.

As best shown in FIG. 4, the inner end of each injector 25 is sealed to the respective bore 20*a–g* and 22 by an annular seal, such as an O-ring 27 which is mounted in an annular groove in the injector. The diameter of resilient O-ring 27 is greater than the diameter of the groove, so that the O-ring projects radially beyond the outer surface of the injector, thus permitting limited tilt of the injector relative to the injector bore for assembly of the injector with the intake manifold runner. Located outwardly of O-ring 27 is an annular cushion 29 formed of a resilient material, such as rubber or plastic. Cushion 29 is formed with a central section of reduced diameter and opposed end sections. One end section bears against surface 5 of the fuel rail 1, while the opposite end section of cushion 29 engages the upper end of reduced diameter section 26*a* of injector 26. In the assembled condition, cushion 29 is slightly compressed and serves to take up the slack between these surfaces and urge the injector against shoulder 30*a* of base 30 in runner 31 of the manifold, as seen in FIG. 4.

An annular resilient cushion seal 32, is located around the outer portion of the injector and bears against the inner surface of bore 30. Cushion 32 permits limited tilting movement of the injector 25 relative to bore 20. As previously noted, the axes of one group of bores 20*a–d* are located at an angle with respect to the axes of a second group of bores 20*e–h* and the injector bores 30 in runners 31 are axially aligned with bores 20 in the rail. Because of this, it is necessary to tilt the injectors in order that the injectors can be received within the aligned bores 20 and 30. Thus the O-rings 27 and cushion 32 provide this limited degree of tilt to facilitate assembly of the injectors with the bores 20 and 30.

The invention provides a simple and compact fuel rail assembly having particular use in marine engines. As both of the passages 6 and 7 are located within the rail 1, the need for external hoses to connect the high pressure and low pressure tubes, as used in the past, is eliminated.

Further, by locating the pressure regulator between the high pressure and low pressure passages at a substantial distance removed from the vapor separating tank, separation of the vapor from the fuel is facilitated.

Various modes of carrying out the invention are contemplated as being within the scope of the following claims, particularly pointing out and distinctly claiming the subject matter which is regarded as the invention.

We claim:

1. A fuel rail assembly for an internal combustion marine engine, comprising an elongated rail having an inlet passage connected to a fuel supply line and having a plurality of parallel bores each connected with said passage and extending to the exterior of the rail, a fuel injector mounted within each injector bore and disposed to inject fuel into a runner of a manifold, an annular seal sealing each injector to the respective bore, and annular resilient cushioning means located outwardly of the rail and disposed around the injector and engaged with an outer surface of said rail, said cushioning means being constructed and arranged to urge the injector axially outward of said bore and into engagement with an abutment bordering an opening in the runner of said manifold.

2. A fuel rail assembly for an internal combustion marine engine, comprising an elongated fuel rail having a fuel inlet passage, said rail having a plurality of first injector bores providing communication between said inlet passage and the exterior of said rail, the axes of said first bores being parallel to each other, said fuel rail also having a second injector bore extending from the exterior of said rail and having a closed inner end, the axis of said second bore being parallel to the axes of said first bores, one end of said rail having a notch and an end of said inlet passage communicating with said notch, said rail also having a connecting passage interconnecting the inner end of said second bore and said inlet passage, the axis of said connecting passage being disposed at an angle to the axes of said first bores, and a fuel injector mounted in each of said first bores and in second bore and disposed to inject fuel into a manifold.

3. A fuel rail assembly for an internal combustion marine engine, comprising an elongated rail having a first end and a second end, said rail having an inlet passage extending between said ends, said inlet passage having an upstream end located at the first end of the rail and connected to a fuel supply line, said rail also having a return passage disposed parallel to said inlet passage, said return passage having an upstream end located at the second end of the rail and having a downstream end located at the first end of the rail and connected to a fuel return line, the lower extremity of said inlet passage being at a vertical level above the upper extremity of said return passage, said rail having a row of first injector bores connected to the inlet passage and extending to the exterior of the rail, said rail also having a row of second injector bores connected to the inlet passage and extending to the exterior of the rail, the axes of the first injector bores being disposed at an angle to the axes of the second injector bores, said row of first injector bores located on one side of said return passage and the row of second injector bores located on the opposite of said return passage, and a fuel injector mounted in each injector bore and disposed to inject fuel into a manifold.

4. A fuel rail assembly for an internal combustion engine, comprising a elongated rail having a first end surface and an opposed second end surface, said rail having an inlet passage extending between said end surfaces, said inlet passage having an upstream end located at said first end surface and having a downstream end located at said second end surface, said rail having a return passage extending between said end surfaces, said return passage having an upstream end located at said second end surface and having a downstream end located at said first end surface, fuel supply means mounted on said first end surface for supplying fuel to said inlet passage, fuel return means mounted on said first end surface for returning fuel to a vapor separating tank, pressure regulator means mounted on the second end surface and interconnecting the downstream end of the inlet passage and the upstream end of the return passage, said rail having a plurality of injector bores connected to the inlet passage and extending to the exterior of the rail, and a fuel injector mounted in each injector bore and disposed to inject fuel into a runner of a manifold, said pressure regulator means being constructed and arranged to reduce the pressure of the fuel entering the return passage and promote vaporization of the fuel, vaporized fuel flowing through the return passage tending to coalesce into liquid before returning to the separator tank.

5. The assembly of claim 4, wherein said injector bores include a first group of bores and a second group of bores, the axes of the first group of bores being disposed at an angle to the axes of the second group of bores.

6. The assembly of claim 5, and including annular sealing means for sealing each injector to the respective bore, and an annular resilient cushioning means disposed around the injector and engaged with an outer surface of said rail, said cushioning means being constructed and arranged to urge the injector axially outward of said bore and into engagement with an abutment bordering an opening in a manifold.

7. The assembly of claim 6, wherein said cushioning means is located axially outward of said annular sealing means.

8. The fuel assembly of claim 5, wherein the axes of the bores of both the first and second group are disposed at an acute angle to the horizontal.

9. The assembly of claim 4, wherein said rail is an aluminum extrusion.

10. The assembly of claim 4, wherein the second end surface of said rail is provided with a notch and said pressure regulating means is mounted in said notch, said pressure regulating means includes a first port connected with the downstream end of the inlet passage and a second port connected with the upstream end of said return passage.

11. The assembly of claim 4, wherein the first end surface of said rail is formed with a notch to allow clearance to receive a distributor, one of said injector bores located adjacent said first end surface of the rail includes an outer bore section disposed generally normal to the outer surface of the rail and an inner bore section communicating with the outer bore section and extending diagonally of said inner bore section and communicating with said inlet passage.

12. The engine of claim 5, wherein said inlet passage is located above said return passage, said bores extending downwardly and outwardly from said inlet passage, said first group of bores extending on one side of said return passage and the second group of said injector bores extending on the opposite side of said return passage.

13. The assembly of claim 12, wherein said rail includes an upper surface and a lower surface disposed generally parallel to said upper surface, said rail also having a pair of inclined side surfaces, the outer ends of said injector bores terminating in said inclined surfaces.

14. The assembly of claim 13, wherein the outer ends of said first group of injector bores terminate in a first of said inclined side surfaces and the outer ends of the second group of said injector bores terminate in a second of said inclined side surfaces.

* * * * *